US007600500B2

(12) United States Patent
Mizuno et al.

(10) Patent No.: US 7,600,500 B2
(45) Date of Patent: Oct. 13, 2009

(54) LUBRICATING SYSTEM FOR INTERNAL COMBUSTION ENGINE

(75) Inventors: Kinya Mizuno, Saitama (JP); Hiroshi Sotani, Saitama (JP); Dai Arai, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 194 days.

(21) Appl. No.: 11/604,366

(22) Filed: Nov. 27, 2006

(65) Prior Publication Data

US 2007/0119405 A1 May 31, 2007

(30) Foreign Application Priority Data

Nov. 30, 2005 (JP) ..... 2005-345944

(51) Int. Cl.
*F01M 1/02* (2006.01)
*F02M 9/10* (2006.01)
*F02M 11/02* (2006.01)

(52) U.S. Cl. ..... 123/196 R

(58) Field of Classification Search ..... 123/196 R, 123/198 C, 196 CP, 195 C, 198 P, 197.5
See application file for complete search history.

(56) References Cited

U.S. PATENT DOCUMENTS 6,253,727 B1 * 7/2001 Tosaka et al. ..... 123/196 CP
6,305,342 B1 * 10/2001 Narita et al. ..... 123/196 R
6,332,444 B1 * 12/2001 Narita et al. ..... 123/196 R
7,089,904 B2 * 8/2006 Morii et al. ..... 123/196 R
7,124,732 B2 * 10/2006 Sugamuna et al. ..... 123/196 R
7,363,904 B2 * 4/2008 Utsumi et al. ..... 123/196 R
2002/0011230 A1 * 1/2002 Furuya ..... 123/195 C
2007/0119405 A1 * 5/2007 Mizuno et al. ..... 123/196 R

FOREIGN PATENT DOCUMENTS

JP 11-81950 A 3/2006

* cited by examiner

*Primary Examiner*—Stephen K Cronin
*Assistant Examiner*—Sizo B Vilakazi
(74) *Attorney, Agent, or Firm*—Birch, Stewart, Kolasch & Birch, LLP

(57) ABSTRACT

A lubricating system for an internal combustion engine in which oil in a crankcase is supplied into an oil tank by a scavenging pump wherein it is possible to reduce the size of an engine body and the size of the scavenging pump. An oil tank is provided in an engine body adjacent, in the direction along the axis of a crankshaft, to a centrifugal clutch contained in a clutch containing chamber communicating with the inside of a crank chamber. A wall portion for partitioning the inside of the oil tank and the clutch containing chamber from each other is provided with an opening portion for communication between the clutch containing chamber and the inside of the oil tank, the opening portion being located on the outer side relative to the outermost rotational locus of a centrifugal clutch as viewed in the direction along the axis of the crankshaft.

18 Claims, 4 Drawing Sheets

LUBRICATING SYSTEM FOR INTERNAL COMBUSTION ENGINE

CROSS-REFERENCE TO RELATED APPLICATIONS

The present application claims priority under 35 USC 119 to Japanese Patent Application No. 2005-345944 filed on Nov. 30, 2005 the entire contents of which are hereby incorporated by reference.

BACKGROUND OF THE INVENTION

1. Field of the Invention

The present invention relates to a lubricating system for an internal combustion engine, including an oil tank provided in an engine body having a crankcase which rotatably bears a crankshaft fitted with a centrifugal clutch at one end portion thereof and which defines a crank chamber. A feed pump is provided for supplying oil in the oil tank to the engine body with a scavenging pump for returning the oil collecting in a bottom portion of the crank chamber into the oil tank.

2. Description of Background Art

A lubricating system for an internal combustion engine is disclosed in Japanese Patent Laid-open No. Hei 11-81950 wherein an oil tank is disposed on a lateral side of a crankshaft that is rotatably supported on a crankcase in an engine body and oil raked up by a balance weight of the crankshaft is received by the oil tank.

In the lubricating system disclosed in Japanese Patent Laid-open No. Hei 11-81950, it is necessary to lay out the oil tank on the outer side of the rotational locus of the balance weight. Thus, it is necessary to provide a predetermined space in the crankcase which results in an increase in the size of the engine body.

SUMMARY AND OBJECTS OF THE INVENTION

The present invention has been made in consideration of the above-mentioned circumstances. Accordingly, it is an object of the present invention to provide a lubricating system for an internal combustion engine in which oil in a crankcase is supplied into an oil tank by a scavenging pump and in which it is possible to reduce the size of the engine body and the size of the scavenging pump.

In order to attain the above object, an embodiment of the present invention provides a lubricating system for an internal combustion engine that includes an oil tank provided in an engine body having a crankcase which rotatably bears a crankshaft fitted with a centrifugal clutch at one end portion thereof for defining a crank chamber. A feed pump is provided for supplying oil in the oil tank to a portion to be supplied with the oil of the engine body. A scavenging pump is provided for returning the oil collecting in a bottom portion of the crank chamber into the oil tank. The oil tank is provided adjacent to the engine body, in the direction along the axis of the crankshaft. The centrifugal clutch includes a clutch containing chamber communicating with the inside of the crank chamber. A wall portion partitions the inside of the oil tank and the clutch containing chamber from each other and is provided with an opening portion for communication between the clutch containing chamber and the inside of the oil tank with the opening portion being located on the outer side relative to the outermost rotational locus of the centrifugal clutch as viewed in the direction along the axis of the crankshaft.

In addition, an embodiment of the present invention provides that the opening portion is disposed on the upper side relative to the axis of rotation of the crankshaft.

In an embodiment of the present invention, the oil tank includes a crankcase cover joined to the crankcase in a manner for defining the clutch containing chamber between itself and the crankcase with a tank cover joined to the crankcase cover. A return hole is provided for returning into the oil tank the oil discharged from an oil pressure control unit attached to the crankcase cover at a portion corresponding to the upper side of the oil tank in the crankcase cover so as to communicate with the inside of the oil tank.

In an embodiment of the present invention, the crankcase cover is integrally provided with a rib that projects for leading to the return hole the oil discharged from the oil pressure control unit attached to the crankcase cover.

In addition, a first crankcase cover 23 in the following embodiment corresponds to the "wall portion" in an embodiment of the invention.

According to an embodiment of the invention, the oil tank is provided in the engine body adjacent to the centrifugal clutch in the direction along the axis of the crankshaft, and the opening portion for communication between the clutch containing chamber and the inside of the oil tank is provided on the outer side relative to the outermost rotation locus of the centrifugal clutch as viewed in the direction along the axis of the crankshaft. Therefore, when the inside of the oil tank is filled up with oil, the oil in the oil tank can overflow to the side of the clutch containing chamber communicating with the crank chamber. When the oil reserved in the oil tank is small in volume, the oil raked up by the centrifugal clutch in the clutch containing chamber can be returned through the opening portion into the oil tank. Accordingly, it is possible to set the capacity of the oil tank to a comparatively small value, thereby contriving a reduction in the size of the engine body, and to alleviate the burden on the scavenging pump, thereby contriving the size of the scavenging pump.

According to an embodiment of the invention, the amount of the oil reserved in the oil tank can be easily increased.

According to an embodiment of the invention, the oil discharged from the oil pressure control unit can be returned into the oil tank while adopting a simple configuration. Thus, the burden on the scavenging pump can be alleviated further.

Furthermore, according to an embodiment of the invention, the oil discharged from the oil pressure control unit can be returned to the oil tank side efficiently.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Now, a mode for carrying out the present invention will be described, based on an embodiment of the invention shown in the accompanying drawings.

Figure 1:
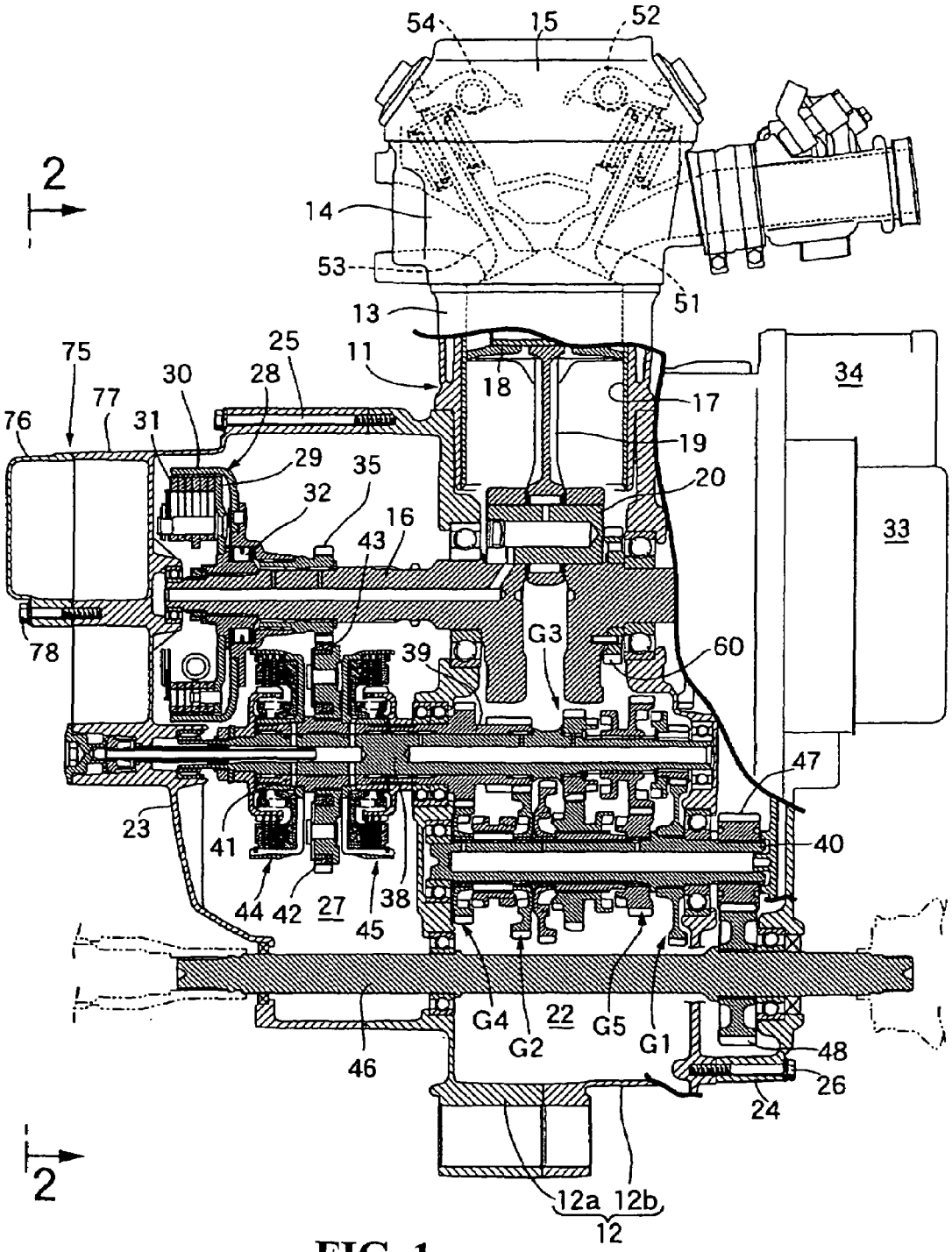
FIG. 1 is a vertical side view of an internal combustion engine.
Figure 2:
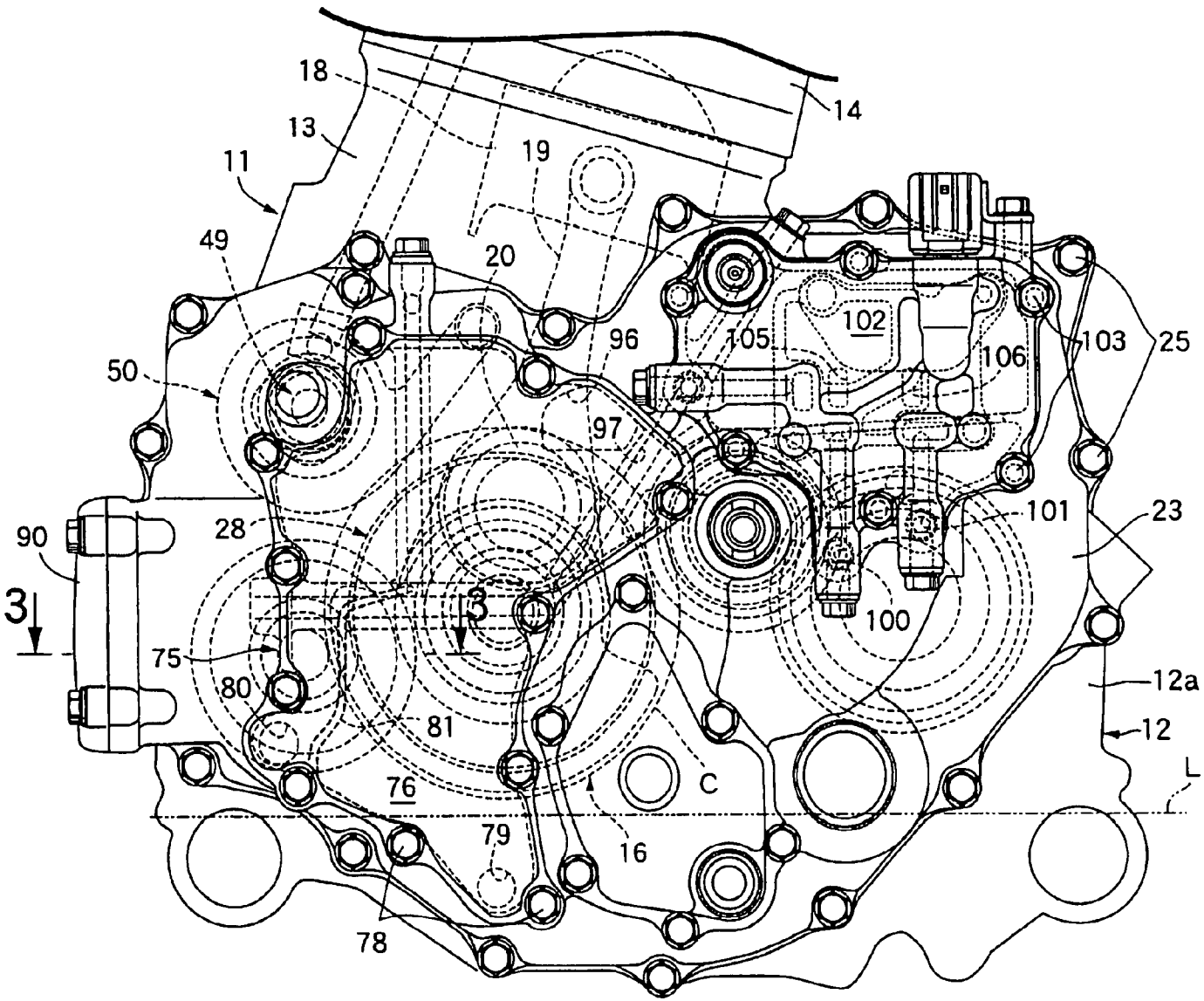
FIG. 2 is an enlarged view taken along arrows 2-2 of FIG. 1.

As illustrated in FIGS. 1 and 2, an engine body 11 of this internal combustion engine includes a crankcase 12 for rotatably bearing a crankshaft 16, a cylinder block 13 joined to an upper portion of the crankcase 12, a cylinder head 14 joined to an upper portion of the cylinder block 13, and a head cover 15 joined to an upper portion of the cylinder head 14. In the engine body 11, a piston 18, slidably fitted in a cylinder bore 17 in the cylinder block 13, is connected to the crankshaft 16 through a connecting rod 19 and a crank pin 20.

The crankcase 12 is composed of a pair of case halves 12*a* and 12*b* coupled at a plane orthogonal to the axis of rotation of the crankshaft 16, and a crank chamber 22 is defined inside the crankcase 12. In addition, first and second crankcase covers 23 and 24 constituting a part of the engine body 11 are fastened to both sides of the crankcase 12 by pluralities of bolts 25 and 26, respectively, and a clutch containing chamber 27 communicating with the inside of the crank chamber 22 is defined between the crankcase 12 and the first crankcase cover 23.

One end of the crankshaft 16 that projects from the crankcase 12 is rotatably borne on the first crankcase cover 23, and a centrifugal clutch 28 contained in the clutch containing chamber 27 is mounted through a one-way clutch 32 onto one end portion of the crankshaft 16 at a position proximate to the first crankcase cover 23. A recoil starter 33, to which a generator (not shown) disposed between the crankcase 12 and the second crankcase cover 24 is connected and which is attached to the second crankcase cover 24, is connected to the other end portion of the crankshaft 16 projecting from the crankcase 12. In addition, a starter motor 34 for inputting a starting power to the crankshaft 16 is attached to the second crankcase cover 24.

The centrifugal clutch 28 includes a drive plate 29 fixed to the crankshaft 16, a bowl-like clutch housing 30 coaxially covering the drive plate 29 so as to be rotated together with a drive gear 35 relatively rotatably mounted onto the crankshaft 16, and a clutch weight 31 turnably supported on the drive plate 29 so as to be capable of frictional contact with the inner periphery of the clutch housing 30 according to the action of a centrifugal force attendant on the rotation of the crankshaft 16. The one-way clutch 32 is provided between the clutch housing 30 and the drive plate 29 so as to enable transmission of power from the drive gear 35 to the crankshaft 16.

The oil is reserved in the crank chamber 22 and the clutch containing chamber 27 up to a level L shown in FIG. 2. During operation of a vehicle with the internal combustion engine being mounted thereto, the oil splashes onto the clutch housing 30 of the centrifugal clutch 28, and a portion of the oil is raked up by the clutch housing 30 of the centrifugal clutch 28.

First and second main shafts 38 and 39 are constructed to be capable of relative rotation about the same axis and are borne on the crankcase 12 so as to be rotatable about an axis parallel to the axis of rotation of the crankshaft 16. A counter shaft 40, parallel to the first and second main shafts 38 and 39, is rotatably borne on the crankcase 12. In addition, a plurality of speed change stages, for example, first to fifth speed change stages of gear trains G1 to G5 which can be selectively established, are contained in the crank chamber 22. The first, third and fifth speed change stages of gear trains G1, G3 and G5 are provided between the first main shaft 38 and the counter shaft 40, whereas the second and fourth speed change stages of gear trains G2 and G4 are provided between the second main shaft 39 and the counter shaft 40.

A transmission tubular shaft 41 is relatively rotatably mounted onto the first main shaft 38 inside the clutch containing chamber 27, and power is transmitted to the transmission tubular shaft 41 through the drive gear 35 relatively rotatably mounted onto the crankshaft 16, a driven gear 42 meshed with the drive gear 35, and a rubber damper 43. In addition, a first hydraulic clutch 44 is provided between the transmission tubular shaft 41 and the first main shaft 38, and a second hydraulic clutch 45 is provided between the transmission tubular shaft 41 and the second main shaft 39.

When the first hydraulic clutch 44 is in its power transmitting state and power is being transmitted to the first main shaft 38 from the crankshaft 16, power is transmitted from the first main shaft 38 to the counter shaft 40 through a selectively established one of the first, third and fifth speed change stages of gear trains G1, G3 and G5. When the second hydraulic clutch 45 is in its power transmitting state and power is being transmitted to the second main shaft 39 from the crankshaft 16, power is transmitted from the second main shaft 39 to the counter shaft 40 through a selectively established one of the second and fourth speed change stages of gear trains G2 and G4.

An output shaft 46 with an axis parallel to the axis of rotation of the crankshaft 16 is rotatably borne by one 12*a* of the case halves 12*a* and 12*b* of the crankcase 12 and by the second crankcase cover 24, and both ends of the output shaft 46 project outwards by penetrating through the first and second crankcase covers 23 and 24 in a liquid-tight and rotatable manner. On the other hand, a drive gear 47 is fixed to an end portion of the counter shaft 40 projecting from the other 12*b* of the case halves 12*a* and 12*b* of the crankcase 12, and a driven gear 48 meshed with the drive gear 47 is provided on the output shaft 46.

As illustrated in FIG. 2, a camshaft, rotatable about an axis parallel to the axis of rotation of the crankshaft 16, is disposed on the skew upper side of the crankshaft 16 in the state of being rotatably borne on the crankcase 12, and the rotating power of the crankshaft 16 is transmitted to the camshaft 49 through speed reduction by a factor of ½. In addition, a water pump 50 connected coaxially to the camshaft 49 is attached to the crankcase 12 so as to be covered by the first crankcase cover 23.

An intake-side rocker arm 52 for driving an intake valve 51 to open and close and an exhaust-side rocker arm 54 for driving an exhaust valve 53 to open and close are swingably borne on the cylinder head 14. The rotating power of the camshaft 49 is converted into a swinging motion of the intake-side rocker arm 52 through a push-rod (not shown), whereas the rotating power of the camshaft 49 is converted into a swinging motion of the exhaust-side rocker arm 54 through a push-rod 56.

Figure 3:
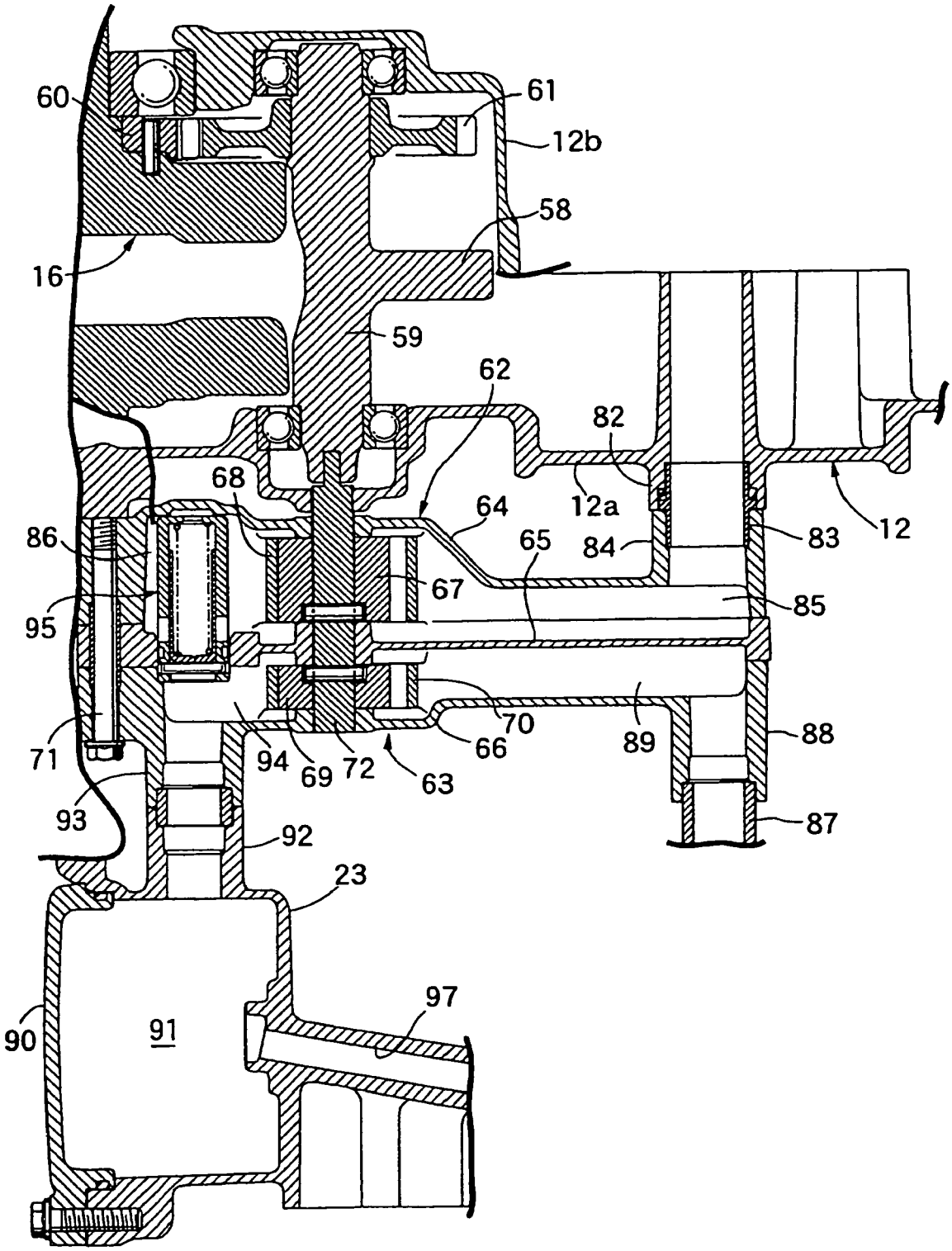
FIG. 3 is an enlarged sectional view taken along line 3-3 of FIG. 2.

In FIG. 3, a balancer shaft 59 having a balancer weight 58 and having an axis parallel to the axis of rotation of the crankshaft 16 is rotatably borne on the crankcase 12 on the skew lower side of the crankshaft 16. The rotating power of the crankshaft 16 is transmitted to the balancer shaft 59 through a drive gear 60 fixed to the crankshaft 16 and a driven gear 61 fixed to the balancer shaft 59 and meshed with the drive gear 60.

A scavenging pump 62 and a feed pump 63 that are coaxial with each other are disposed in the clutch containing chamber 27. The scavenging pump 62 is of the trochoid type in which an inner rotor 67 and an outer rotor 68 are contained between first and second bodies 64 and 65 coupled to each other. The feed pump 63 is of the trochoid type in which an inner rotor 69 and an outer rotor 70 are contained between second and third bodies 65 and 66 coupled to each other.

The first to third bodies 64 to 66 are fastened in common by a plurality of bolts 71, with the second body 65 clamped between the first and the third bodies 64 and 66. In addition, the scavenging pump 62 and the feed pump 63 share in common a pump shaft 72 rotatably borne on the first to third bodies 64 to 66 with the pump shaft 72 being connected to the balancer shaft 59 in a relatively non-rotatable and coaxial manner. The inner rotors 67 and 69 of the scavenging pump 62 and the feed pump 63 are fixed to the pump shaft 72, and the outer rotors 68 and 70 are meshed with the inner rotors 67 and 69, respectively.

The feed pump 63 supplies oil in the oil tank 75 provided in the engine body 11 to a portion to be supplied with the oil of the engine body 11, whereas the scavenging pump 62 is for returning the oil collecting in a bottom portion of the crank chamber 22 into the oil tank 75.

Figure 4:
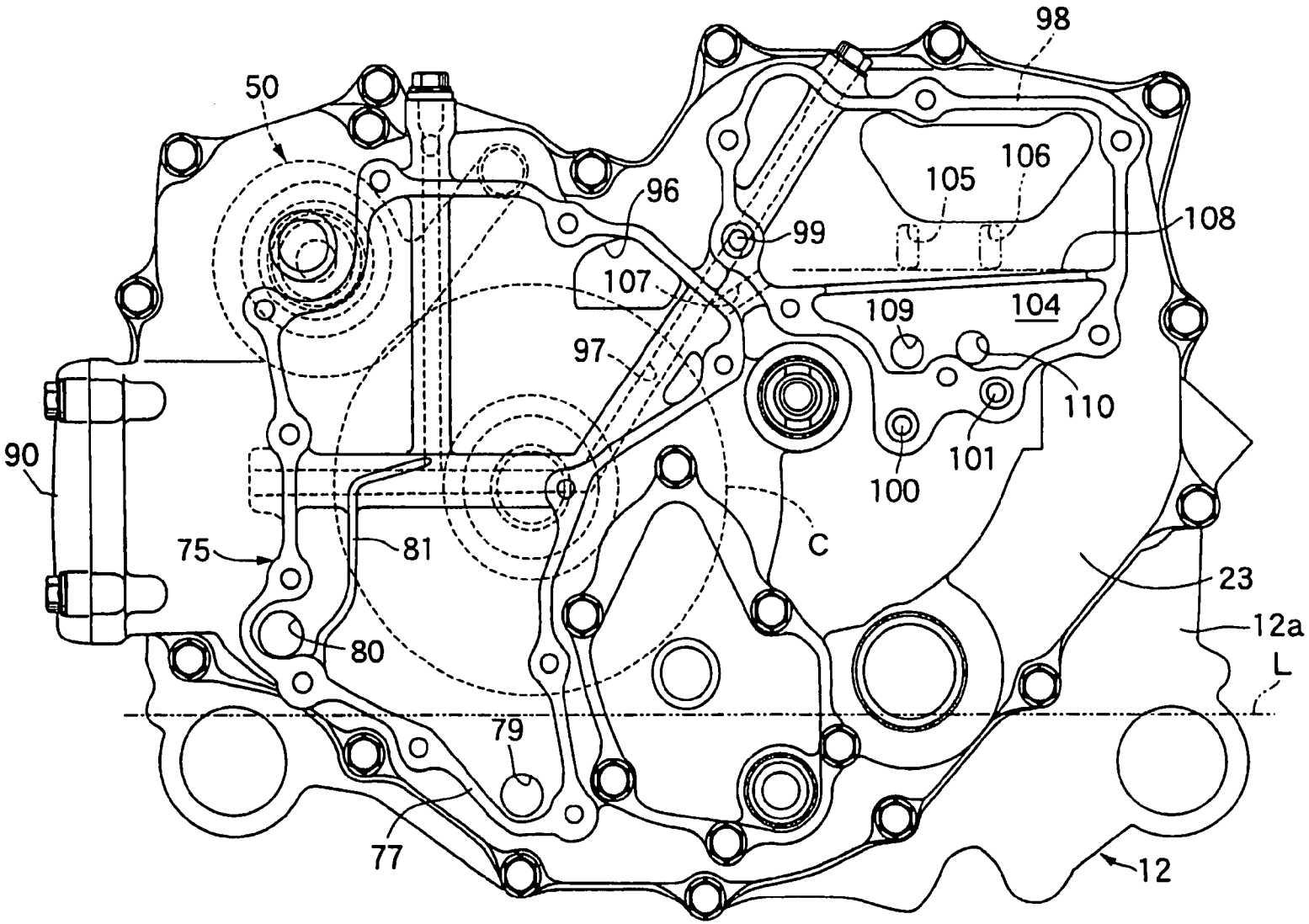
FIG. 4 is a side view of a crankcase and a crankcase cover in the condition where a tank cover and an oil pressure control unit have been removed.

Referring to FIG. 4, the oil tank 75 is disposed to be adjacent, in the direction along the axis of the crankshaft 16, to the centrifugal clutch 28 contained in the clutch containing chamber 27. The oil tank 75 includes the first crankcase cover 23 joined to the crankcase 12 so as to define the clutch containing chamber 27 between itself and the crankcase 12, and a tank cover 76 joined to the first crankcase cover 23. More specifically, a side wall portion 77 continuous in a loop form is provided to be integral and to project from an outside surface of the first crankcase cover 23. A peripheral portion of the tank cover 76 is fastened to the side wall portion 77 by a plurality of bolts 78.

The first crankcase cover 23 is provided with an outlet hole 79 opening into a lower portion of the oil tank 75, and an inlet hole 80 opening into the oil tank 75 on the upper side of the outlet hole 79. A guide wall portion 81 is provided to extend vertically between the inlet hole 80 and the outlet hole 79, and the oil entering the oil tank 75 through the inlet hole 80 flows over the guide wall portion 81 to the outlet hole 79 side.

As illustrated in FIG. 3, the first body 64 of the scavenging pump 62 is provided integrally with a suction pipe portion 84, which is connected through a connection pipe 83 to a connection tubular portion 82 provided in the case half 12*a* of the crankcase 12. Between the first and second bodies 64 and 65, a suction passage 85 communicating with the suction pipe portion 84 is formed, and a discharge passage 86 communicating with the inlet hole 80 opening into the oil tank 75 is formed. The oil collecting in a lower portion of the crank chamber 22 is sucked by the scavenging pump 62 through the connection tubular portion 82, the connection pipe 83, the suction pipe portion 84 and the suction passage 85, and the oil is supplied from the scavenging pump 62 into the oil tank 75 through the discharge passage 86 and the inlet hole 80.

In addition, the third body 66 possessed by the feed pump 63 is provided integrally with a suction pipe portion 88, which is connected through a connection pipe 88 to the outlet hole 79 opening into the oil tank 75, and a suction passage 89 communicating with the suction pipe portion 88 is formed between the second and third bodies 65 and 66.

An oil sump 91 is formed between the first crankcase cover 23 and a cover 90 fastened to the first crankcase cover 23, and the first crankcase cover 23 is provided integrally with a connection pipe portion 92 communicating with the oil sump 91. On the other hand, the third body 66 of the feed pump 63 is provided integrally with a discharge pipe portion 93, which is connected to the connection pipe portion 92. The discharge pipe portion 93 communicates with a discharge passage 94 formed between the second and third bodies 65 and 66.

In addition, a relief valve 95, which is opened as the discharge pressure of the feed pump 63 reaches or exceeds a preset pressure so as to release the oil from the discharge passage 94 of the feed pump 63 into the discharge passage 86 of the scavenging pump 62, is provided between the discharge passage 86 of the scavenging pump 62 and the discharge passage 94 of the feed pump 63.

The oil tank 75 is provided at the first crankcase cover 23 constituting a part of the engine body 11 that is adjacent, in the direction along the axis of the crankshaft 16, to the centrifugal clutch 28 contained in the clutch containing chamber 27 communicating with the inside of the crank chamber 22. The first crankcase cover 23 as a wall portion partitioning the inside of the oil tank 75 and the clutch containing chamber 27 from each other is provided with an opening portion 96 for communication between the clutch containing chamber 27 and the inside of the oil tank 75. The opening portion 96 is located on the outer side relative to the outermost rotation locus C of the centrifugal clutch 28, namely, the rotation locus of the outer periphery of the clutch housing 30, as viewed in the direction along the axis of the crankshaft 16, and on the upper side relative to the axis of rotation of the crankshaft 16.

The first crankcase cover 23 is provided with an oil passage 97 for leading the oil from the oil sump 91 to the portion to be supplied with the oil of the engine body 11. A passage 99 communicating with the oil passage 97 and oil passages 100 and 101 communicating respectively with the first and second hydraulic clutches 44 and 45 are opened in a loop form attaching wall portion 98 that is provided to project from the first crankcase cover 23 at a portion corresponding to a skew upper side of the oil tank 75.

An oil pressure control unit 102 for controlling the oil pressure(s) acting in the oil passages 100 and 101, namely, the oil pressure(s) acting on the first and second hydraulic clutches 44 and 45 on the basis of the oil pressure led through the passage 99 is attached to the attaching wall portion 98 by a plurality of bolts 103. The oil pressure control unit 102 is attached to the first crankcase cover 23 at a portion corresponding to a skew upper side of the oil tank 75.

An oil chamber 104 is formed between the oil pressure control unit 102 and the first crankcase cover 23. The oil pressure control unit 102 is provided with drain holes 105 and 106 for discharging the oil at the time of variations in the operation thereof. The drain holes 105 and 106 are provided so as to open into the oil chamber 104. More specifically, the oil is discharged from the oil pressure control unit 102 into the oil chamber 104. A return hole 107 is provided for returning this oil into the oil tank 75 in the first crankcase cover 23 in the manner of providing communication between the inside of the oil chamber 104 and the inside of the oil tank 75.

In addition, the first crankcase cover 23 is integrally provided to project with a rib 108 for receiving the oil discharged from the oil pressure control unit 102 and leading the oil to the return hole 107. The rib 108 is disposed on the lower side relative to the drain holes 105 and 106, and is provided on the first crankcase cover 23 in the state of being inclined to become lower as one goes toward the return hole 107 side, with reference to the horizontal line represented by chain line in FIG. 4.

Furthermore, the first crankcase cover 23 is provided with a pair of communication holes 109 and 110 located on the lower side relative to the rib 108 so that the oil chamber 104 communicates with the clutch containing chamber 27. The communication holes 109 and 110 function to return to the clutch containing chamber 27 side the oil collecting in the oil chamber 104 on the lower side relative to the rib 108.

In operation of this embodiment, the oil tank 75 is provided in the engine body 11 adjacent, in the direction along the axis of the crankshaft 16, to the centrifugal clutch 28 contained in the clutch containing chamber 27 communicating with the inside of the crank chamber 22. The first crankcase cover 23 is provided, as a wall portion partitioning the inside of the oil tank 75 and the clutch containing chamber 27 from each other, with the opening portion 96 for communication between the clutch containing chamber 27 and the inside of the oil tank 75. The opening portion 96 is located on the outer side relative to the outermost rotational locus C of the centrifugal clutch 28 as viewed in the direction along the axis of the crankshaft 16.

When the inside of the oil tank 75 is filled up with oil, the oil in the oil tank 75 can be permitted to flow over to the side of the clutch containing chamber 27 communicating with the crank chamber 22. When the oil reserved in the oil tank 27 is of a small volume, the oil raked up by the centrifugal clutch 28 inside the clutch containing chamber 27 can be returned into the oil tank 75 through the opening portion 96. Accordingly, it is possible to set the capacity of the oil tank 75 to a comparatively low value, thereby contriving a reduction in the size of the engine body 11. Thus, the burden is alleviated on the scavenging pump 62 for returning into the oil tank 75 the oil collecting in a bottom portion of the crank chamber 22. Therefore, a decrease in the size of the scavenging pump 62 is possible.

In addition, since the opening portion 96 is arranged on the upper side relative to the axis of rotation of the crankshaft 16, the amount of the oil reserved in the oil tank 75 can be easily increased.

Moreover, the oil tank 75 includes the first crankcase cover 23 joined to the crankcase 12 in the manner of defining the clutch containing chamber 27 between itself and the crankcase 12, and the tank cover 76 joined to the first crankcase cover 23. The return hole 107, for returning into the oil tank 75 the oil discharged from the oil pressure control unit 102 attached to the first crankcase cover 23 at a portion corresponding to the upper side of the oil tank 75, is provided in the first crankcase cover 23 so as to communicate with the inside of the oil tank 75. Therefore, the oil discharged from the oil pressure control unit 102 can be returned into the oil tank 75 while adopting a simple configuration. Thus, the burden on the scavenging pump 62 can be alleviated.

Furthermore, since the first crankcase cover 23 includes the rib 108 that is integrally projecting therefrom for leading to the return hole 107 the oil discharged from the oil pressure control unit 102, the oil discharged from the oil pressure control unit 102 can be efficiently returned to the oil tank 75 side.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating system for an internal combustion engine, comprising:

an oil tank provided in an engine body having a crankcase which rotatably bears a crankshaft fitted with a centrifugal clutch at one end portion thereof and which defines a crank chamber;

a feed pump for supplying oil in said oil tank to a portion to be supplied with the oil of said engine body; and a scavenging pump for returning the oil collecting in a bottom portion of said crank chamber into said oil tank;

wherein said oil tank is provided in said engine body adjacent, in the direction along the axis of said crankshaft, to said centrifugal clutch contained in a clutch containing chamber communicating with the inside of said crank chamber;

a wall portion partitioning the inside of said oil tank and said clutch containing chamber from each other is provided with an opening portion for communication between said clutch containing chamber and the inside of said oil tank; and said opening portion is located on the outer side relative to the outermost rotational locus of said centrifugal clutch as viewed in the direction along the axis of said crankshaft, wherein said oil tank includes a crankcase cover joined to said crankcase in a manner for defining said clutch containing chamber between the oil tank and said crankcase and a tank cover joined to said crankcase cover, and a return hole, for returning into said oil tank the oil discharged from an oil pressure control unit attached to said crankcase cover at a portion corresponding to an upper side of said oil tank, is provided in said crankcase cover so as to communicate with the inside of said oil tank, wherein said crankcase cover includes a rib that is integral therewith and projects therefrom for leading to said return hole the oil discharged from said oil pressure control unit attached to said crankcase cover.

2. The lubricating system for an internal combustion engine as set forth in claim 1, wherein said opening portion is disposed on the upper side relative to the axis of rotation of said crankshaft.

3. The lubricating system for an internal combustion engine as set forth in claim 1, wherein said oil tank provided at the crankcase cover constituting a part of the engine that is adjacent, in a direction along the axis of the crankcase, to the centrifugal clutch contained in the clutch containing chamber communicating with the inside of the crank chamber.

4. The lubricating system for an internal combustion engine as set forth in claim 2, wherein said oil tank includes a crankcase cover constituting a part of the engine body that is adjacent, in a direction along the axis of the crankshaft, to the centrifugal clutch contained in the clutch containing chamber communicating with the inside of the crank chamber.

5. The lubricating system adapted for use with an internal combustion engine as set forth in claim 3, wherein said oil pressure control unit is attached to said crankcase cover at a portion corresponding to a skew upper side of the oil tank.

6. The lubricating system adapted for use with an internal combustion engine as set forth in claim 4, wherein said oil pressure control unit is attached to said crankcase cover at a portion corresponding to a skew upper side of the oil tank.

7. A lubricating system for an internal combustion engine, comprising:

an oil tank;

a feed pump for supplying oil in said oil tank to an engine body; and a scavenging pump for returning the oil collecting in a bottom portion of a crank chamber into said oil tank;

wherein said oil tank is provided in said engine body adjacent, in a direction along an axis of a crankshaft, to a centrifugal clutch that is in communication with an inside of said crank chamber;

a wall portion partitioning an inside of said oil tank and a clutch containing chamber from each other, said wall portion being provided with an opening portion for communication between said clutch containing chamber and the inside of said oil tank; and said opening portion being located on an outer side relative to an outermost rotational locus of said centrifugal clutch as viewed in the direction along the axis of said crankshaft, wherein said oil tank includes a crankcase cover joined to a crankcase in a manner for defining said clutch containing chamber between the oil tank and said crankcase and a tank cover joined to said crankcase cover, and a return hole, for returning into said oil tank the oil discharged from an oil pressure control unit attached to said crankcase cover at a portion corresponding to an upper side of said oil tank, is provided in said crankcase cover so as to communicate with the inside of said oil tank, wherein said crankcase cover includes a rib that is integral therewith and projects therefrom for leading to said return hole the oil discharged from said oil pressure control unit attached to said crankcase cover.

8. The lubricating system for an internal combustion engine as set forth in claim 7, wherein said opening portion is disposed on the upper side relative to the axis of rotation of said crankshaft.

9. The lubricating system for an internal combustion engine as set forth in claim 7, wherein said oil tank is provided at the crankcase cover constituting a part of the engine body that is adjacent, in a direction along the axis of the crankshaft, to the centrifugal clutch contained in the clutch containing chamber communicating with the inside of the crank chamber.

10. The lubricating system for an internal combustion engine as set forth in claim 8, wherein said oil tank is provided at the crankcase cover constituting a part of the engine body that is adjacent, in a direction along the axis of the crankshaft, to the centrifugal clutch contained in the clutch containing chamber communicating with the inside of the crank chamber.

11. The lubricating system adapted for use with an internal combustion engine as set forth in claim 9, wherein said oil pressure control unit is attached to said crankcase cover at a portion corresponding to a skew upper side of the oil tank.

12. The lubricating system adapted for use with an internal combustion engine as set forth in claim 10, wherein said oil pressure control unit is attached to said crankcase cover at a portion corresponding to a skew upper side of the oil tank.

13. A lubricating system adapted for use with an internal combustion engine, comprising:

an oil tank;

a feed pump adapted for supplying oil in said oil tank to an engine body; and a scavenging pump adapted for returning the oil collecting in a bottom portion of a crank chamber into said oil tank, and in order to contrive a reduction in size of the engine body, said oil tank is provided in said engine body adjacent, in a direction along an axis of a crankshaft, to a centrifugal clutch that is in communication with an inside of said crank chamber, and is shaped so as to overlap an axial end of the crankshaft and a portion of a water pump;

a wall portion partitioning an inside of said oil tank and a clutch containing chamber from each other, said wall portion being provided with an opening portion for communication between said clutch containing chamber and the inside of said oil tank; and said opening portion being located on an outer side relative to an outermost rotational locus of said centrifugal clutch as viewed in the direction along the axis of said crankshaft, wherein said oil tank includes a crankcase cover joined to a crankcase by a plurality of bolts in a manner for defining said clutch containing chamber between the oil tank and said crankcase and a tank cover joined to said crankcase cover, and a return hole, for returning into said oil tank the oil discharged from an oil pressure control unit attached to said crankcase cover at a portion corresponding to an upper side of said oil tank, is provided in said crankcase cover so as to communicate with the inside of said oil tank, wherein said crankcase cover includes a rib that is integral therewith and projects therefrom for leading to said return hole the oil discharged from said oil pressure control unit attached to said crankcase cover.

14. The lubricating system adapted for use with an internal combustion engine as set forth in claim 13, wherein said opening portion is disposed on an upper side relative to the axis of rotation of said crankshaft.

15. The lubricating system adapted for use with an internal combustion engine as set forth in claim 14, wherein said oil tank includes a crankcase cover attached to a crankcase by a plurality of bolts in a manner for defining said clutch containing chamber between the oil tank and said crankcase and a tank cover joined to said crankcase cover, and a return hole, for returning into said oil tank the oil discharged from an oil pressure control unit attached to said crankcase cover at a portion corresponding to an upper side of said oil tank, is provided in said crankcase cover so as to communicate with the inside of said oil tank.

16. The lubricating system adapted for use with an internal combustion engine as set forth in claim 13, wherein said oil pressure control unit is attached to said crankcase cover at a portion corresponding to a skew upper side of the oil tank.

17. The lubricating system adapted for use with an internal combustion engine as set forth in claim 13, when the engine is viewed in an axial direction of the crankshaft, an oil sump and an output shaft are disposed on opposite lateral sides of the oil tank.

18. The lubricating system adapted for use with an internal combustion engine as set forth in claim 13, when the engine is viewed in an axial direction of the crankshaft, the oil tanks extends further on both lateral sides of the crankshaft than an outermost rotational locus of the centrifugal clutch.

* * * * *